United States Patent [19]

Andrew et al.

[11] 4,145,564

[45] Mar. 20, 1979

[54] NON-CONSUMABLE ELECTRODE WITH REPLACEABLE GRAPHITE TIP

[76] Inventors: Dennie J. Andrew, 12846 Rabbit Run La., Jacksonville, Fla. 32216; Avery Hilton, Jr., 3483 Haitley Rd., Jacksonville, Fla. 32217

[21] Appl. No.: 873,473

[22] Filed: Jan. 30, 1978

[51] Int. Cl.[2] ..... H05B 7/08

[52] U.S. Cl. ..... 13/18 A

[58] Field of Search ..... 13/18 A, 18 C, 15

[56] References Cited

U.S. PATENT DOCUMENTS

| | | | |
|---|---|---|---|
| 2,471,531 | 5/1949 | McIntyre et al. | 13/18 A |
| 2,600,823 | 6/1952 | Zaccagnini | 13/18 A |
| 3,368,019 | 2/1968 | De Corso et al. | 13/18 A |
| 3,392,227 | 7/1968 | Ostberg | 13/18 A |
| 4,024,337 | 5/1977 | Andersson et al. | 13/18 A |

*Primary Examiner*—R. N. Envall, Jr.

*Attorney, Agent, or Firm*—Brown, Flick & Peckham

[57] ABSTRACT

A replaceable graphite electrode tip is detachably connected with the lower end of a metal tube, the upper end of which is rigidly connected to electrical conducting means for supporting the tube from a holder in an electric arc furnace. The tube is protected from the heat of the furnace by refractory material forming a sleeve extending upwardly around the tube from the graphite tip.

2 Claims, 2 Drawing Figures

NON-CONSUMABLE ELECTRODE WITH REPLACEABLE GRAPHITE TIP

One type of electrode for electric arc furnaces is formed from graphite or carbon, both materials being referred to herein as graphite. In use, such an electrode wears away and becomes tapered due to oxidation of the graphite or other factors.

It is among the objects of this invention to provide a non-consumable electrode in which the lower end portion or tip can readily be replaced without replacing the rest of the electrode, and in which the portion of the electrode above the graphite tip has a long life, thus eliminating the oxidation of the upper portion of the electrode column.

The invention is illustrated in the accompanying drawings, in which

Figure 1:
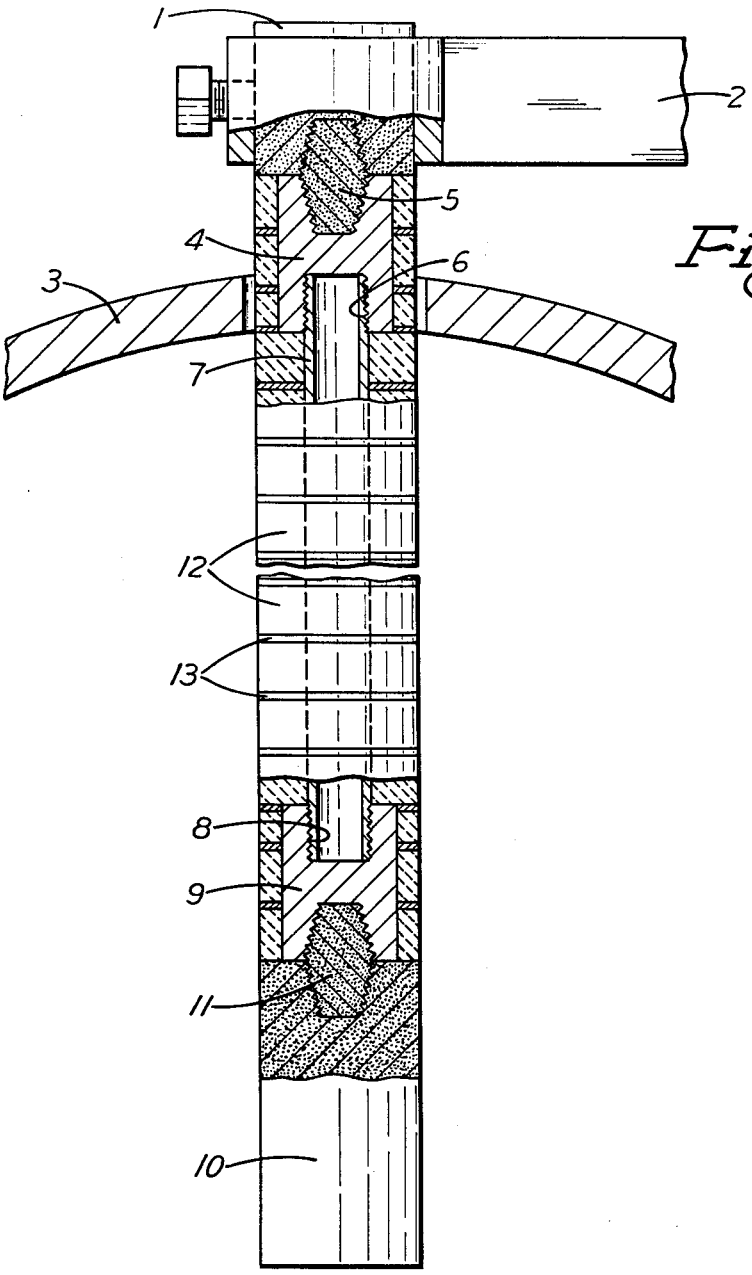
Figure 2:
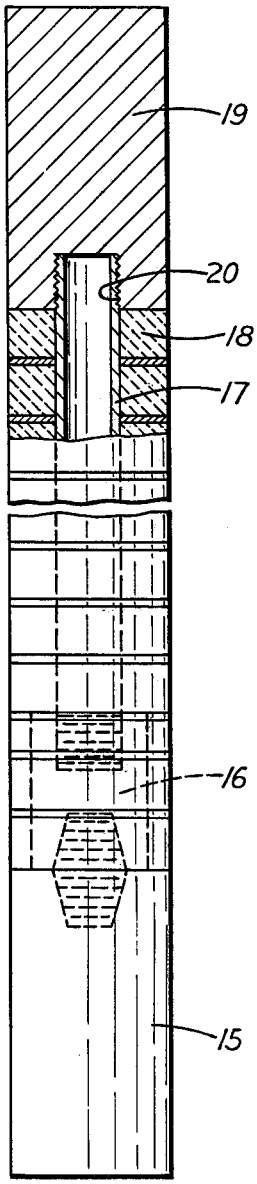

FIG. 1 is a side view of an electrode with parts broken away in vertical section; and FIG. 2 is a similar view of a modification.

Referring to FIG. 1 of the drawings, a short graphite supporting member 1 is clamped in the usual vertically movable electrode holder 2 located above an electric arc furnace 3. Rigidly connected to the lower end of this graphite member is a short metal member 4 of smaller diameter. Preferably, these two members are rigidly but detachably connected together by a connecting pin 5 screwed into opposing threaded sockets in the two members. The pin may be either metal or graphite. The lower end of the metal member likewise is provided with a threaded socket 6, into which the threaded upper end of a metal tube 7 is screwed. The tube extends down through an opening in the top of the furnace and has a threaded lower end that is screwed into a threaded socket 8 in the upper end of a metal connecting member 9 similar to the upper connecting member 4. Rigidly, but detachably connected to this lower metal member, is a graphite electrode tip 10. Preferably, the upper end of this tip and the lower end of the metal member are provided with opposed threaded sockets, in which a threaded graphite or metal pin 11 is screwed. To facilitate removal of the graphite tip from metal member 9, it is preferred that the pin be tapered towards its opposite ends.

To protect the metal tube and the metal connecting members at its opposite ends from the furnace heat, all three are encircled by refractory material that forms a protective sleeve around them extending from the upper end of the graphite tip 10 to the bottom of the graphite supporting member 1 at the top of the electrode. It is generally desirable that the refractory material be electrically conductive or that, as shown, the sleeve be formed from refractory rings 12 that are spaced apart by metal discs 13 which engage the tube. The best material for the tube and the other metal members is copper.

When the graphite tip 10 of the electrode which may, for example, be about two feet long, becomes eroded by spalling, vaporization, impact with scrap and oxidation and requires replacement, the electrode is simply raised above the furnace by holder 2. Then the tip is unscrewed and replaced by a new tip and the electrode is lowered into the furnace again. This operation can be accomplished with little loss of time and without replacing any part of the electrode except its relatively short graphite tip, thereby reducing electrode costs for operating the furnace. The tip can also be replaced by removing the electrode assembly and replacing with a new one.

In the modification shown in FIG. 2 the graphite electrode tip 15, the lower metal connecting member 16, the copper tube 17 and refractory rings 18 are the same as in the first embodiment of the invention. The difference between the two electrodes is in the upper end portions. Instead of having a metal member connecting the upper end of the tube to a graphite member for supporting the electrode in a holder above a furnace, a single copper member 19 is provided with a threaded socket 20 in its lower end, into which the upper end of the tube is screwed. This supporting member 19 is for insertion in an electrode holder for the electrode. As with the first embodiment of the invention, when the graphite tip 15 requires replacement, it is simply unscrewed and replaced by a new tip without affecting the rest of the electrode.

If desired, the metal connecting members between the tubes and the graphite members of the electrodes could be eliminated and the tubes screwed into sockets in the graphite members themselves.

According to the provisions of the patent statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. A non-consumable electrode for suspension from a holder in an electric arc furnace, comprising a metal tube having upper and lower ends, electrical conducting means rigidly connected with the upper end of the tube and extending above it for suspending the tube from a holder gripping said means, a lower metal member provided with threaded sockets in its top and bottom, the lower end of the tube being threaded and screwed into the upper socket, a threaded pin screwed into the lower socket and extending below it, a removable graphite electrode tip supported by said pin, refractory rings encircling said tube, and metal disks encircling the tube in engagement therewith and spacing the rings apart, the rings and disks being in engagement with one another to form a continuous unbroken protective sleeve extending upwardly from said graphite tip to said electrical conducting means.

2. A non-consumable electrode according to claim 1, in which said electrical conducting means includes an upper metal member provided with threaded sockets in its top and bottom, the upper end of the tube being threaded and screwed into the lower socket of said upper metal member, a threaded pin screwed into the upper socket of said upper metal member and extending above it, and a graphite member above said upper metal member and secured to said last-mentioned pin.

* * * * *